US007073746B2

(12) United States Patent
Lorenzo Barroso

(10) Patent No.: US 7,073,746 B2
(45) Date of Patent: Jul. 11, 2006

(54) DEMOUNTABLE REEL

(76) Inventor: Angel Lorenzo Barroso, Pol. Ind. El Cros - Torrent Mada s.n., Argentona, 08310 (ES)

( * ) Notice: Subject to any disclaimer, the term of this patent is extended or adjusted under 35 U.S.C. 154(b) by 90 days.

(21) Appl. No.: 10/777,228

(22) Filed: Feb. 13, 2004

(65) Prior Publication Data

US 2004/0173713 A1 Sep. 9, 2004

(30) Foreign Application Priority Data

Feb. 14, 2003 (ES) ..... 200300362

(51) Int. Cl.
*B65H 75/14* (2006.01)
*B65H 75/18* (2006.01)

(52) U.S. Cl. ..... 242/608.5; 242/118.6

(58) Field of Classification Search ..... 242/608.5, 242/118.6, 118.61
See application file for complete search history.

(56) References Cited

U.S. PATENT DOCUMENTS

| | | | | |
|---|---|---|---|---|
| 3,552,677 | A * | 1/1971 | Hacker | 242/118.61 |
| 3,785,584 | A * | 1/1974 | Crellin, Jr. | 242/118.6 |
| 5,575,437 | A * | 11/1996 | Campbell | 242/608.6 |
| 5,868,348 | A * | 2/1999 | Bulman | 242/608.5 |
| 2002/0053625 | A1* | 5/2002 | Charlton | 242/608.5 |
| 2002/0084377 | A1* | 7/2002 | Hess | 242/608.5 |

FOREIGN PATENT DOCUMENTS

| | | |
|---|---|---|
| EP | 0 342 739 A1 | 5/1989 |
| ES | 1035834 U | 6/1997 |

* cited by examiner

*Primary Examiner*—Kathy Matecki
*Assistant Examiner*—Sang Kim
(74) *Attorney, Agent, or Firm*—Sughrue Mion, PLLC

(57) ABSTRACT

Demountable reel, of those that comprise a hollow cylindrical central body formed by two identical semi-cylindrical halves by a diametral plane and by two essentially flat discs, of greater diameter and equipped with central openings, arranged on the bases of the hollow cylindrical central body, the semi-cylindrical halves having flanges projected transversally inwards or outwards on the rims of their bases, and each disc being equipped, on its inner face, with an annular groove which defines a discontinuous guide rail adapted to removably receive the flanges of one of the ends of the semi-cylindrical halves of the hollow cylindrical central body, each one of the segments of the guide rail and/or the flanges having a progressively variable section, causing, when the hollow cylindrical central body is rotated in relation to the discs in a movement similar to winding, that the clearance between the flanges and the walls of the guide rail which houses them is progressively reduced until it disappears, all the flanges being simultaneously wedged to the guide rail, just having to rotate said central body in the opposite direction to be able to separate the discs.

10 Claims, 3 Drawing Sheets

DEMOUNTABLE REEL

TECHNICAL SECTOR OF THE INVENTION

The invention relates to a demountable reel of those that comprise a hollow cylindrical central body and two essentially flat end discs, of greater diameter and equipped with central openings, arranged on the bases of the hollow cylindrical central body.

BACKGROUND OF THE INVENTION

Some embodiments are already known of reels formed by a cylindrical central body and two end discs which can be removably coupled to the cylindrical central body.

Demountable reels are particularly interesting as once the material stored on them has been consumed, they can be disassembled and sent, in parts, to their corresponding place of origin or supplier, who will be in charge of storing the consumable used on the reel. The fact that the reels are demountable favours their reuse, since transportation or storage costs are greatly reduced in comparison to conventional non-demountable reels. The possibility of disassembling the reel permits the parts comprising it, once uncoupled, to be conveniently placed in boxes or packaging whose volume/weight ratio is much more advantageous than in the case of non-demountable reels.

The patent document EP 0342739 discloses a demountable reel comprising a cylindrical central element and end discs connected thereto, said central element being formed by two sections removably interconnected on an axial plane.

The central element is equipped at its ends with outer grooves that are removably coupled, by rotating the central tube, to coupling parts of the discs, in a position whereat the discs enclose and maintain the sections of the central element joined together. It is fitted together by the housing of protuberances or projections of the disc coupling means in the corresponding recesses of the cylindrical central element. Once coupled, the reel can be disassembled by rotating the central tubes and by elastic deformation of the coupled parts.

In other types of embodiment, the cylindrical central body is equipped at its ends with a respective annular flange which projects outwards and each disc is equipped with an annular groove on the centre of the internal face of the disc, defining a continuous annular cavity adapted to removably house the flanges of the hollow cylindrical central body.

To this effect, an example of a known reel is disclosed in the document ES 1035834 U, wherein the central tube of the reel has, at its ends, projections which fit into notches of the end discs, but in this case said projections are equipped with first elastic elements that fit into indentations, located in the notches of the end discs, when a relative rotation of the tube takes place in relation to the disc improving the coupling of the previous embodiment. Nevertheless, to detach the central tube from the end discs an opening is required on the side of the disc opposite the central tube of the reel to handle the elastic elements using an appropriate tool e.g. a screwdriver or the point of a pen. Furthermore, said embodiment requires second elastic elements, different to the first, so that once the reel is coupled it prevents it from uncoupling when the central tube rotates in the opposite direction to that performed to couple it to the discs.

Although the known embodiments permit the assembly of the reels and their subsequent disassembly, they are not free from problems. Although the discs are coupled to the ends of the main cylindrical body, they remain attached thereto provided that one tries to separate them by exerting a force axially, being able to uncouple the reel by forcing the main body to rotate in relation to the discs. Furthermore, the embodiments that aim to correct said problem, as is the case of document ES 1035834 U, require tools to be able to disassemble the reel.

Furthermore, both embodiments require elastic elements, which, with time, and after successive assembling and disassembling operations, can undergo breakages or simple wear and tear, so that the coupling of the parts is progressively weaker, and may cause the reel to disassemble when being handled or during its use in a machine.

The lack is therefore felt of a demountable reel whose coupling means cannot be worn or, at least, have the least possible, practically negligible, wear, which is in turn easy to assemble, further ensuring that its parts remain suitably coupled despite possible rotation stresses that the cylindrical central body may undergo in relation to the end discs.

EXPLANATION OF THE INVENTION

The demountable reel object of the invention is of those that comprise a hollow cylindrical central body, divided in two identical semi-cylindrical halves by a diametral plane, and two essentially flat discs, of greater diameter and equipped with central openings, arranged on the bases of the hollow cylindrical central body.

The demountable reel is essentially characterized in that the semi-cylindrical halves are equipped, on the rims of their bases, with flanges projected transversally inwards or outwards, and in that each disc is equipped with an annular groove on its inner face, which defines a discontinuous guide rail adapted to removably receive the flanges of one of the ends of the semi-cylindrical halves of the hollow cylindrical central body, each one of the segments of the guide rail and/or the flanges of the semi-cylindrical halves having a progressively variable section, causing, when the hollow cylindrical central body is rotated in relation to the discs in a movement similar to winding, that the clearance between the flanges and the walls of the guide rail which houses them is progressively reduced until it disappears, all the flanges being simultaneously wedged to the guide rail, just having to rotate said central body in the opposite direction to be able to separate the discs.

According to a preferred embodiment, the section of each one of the flanges of the semi-cylindrical halves is homogenous and in that the section of each segment of the guide rails of the disks progressively decreases.

According to another preferred embodiment, the section of the guide rails (9) is homogenous and in that the section of each one of the flanges of the semi-cylindrical halves progressively increases.

According to another preferred embodiment, the section of each one of the flanges of the semi-cylindrical halves progressively increases and in that the section of each segment of the guide rails of the discs progressively decreases.

In a particularly favourable embodiment, the interior diameter of the annular groove is progressively greater in those segments coinciding with the segments of the guide rail, which causes a progressive reduction of the section of the guide rail.

According to another characteristic of the invention, the flanges of the semi-cylindrical halves of the hollow cylindrical central body are of essentially triangular section and the guide rail is of markedly tapered section corresponding to that of the flanges.

According to another characteristic of the invention, the semi-cylindrical halves are equipped at the circumferential ends with quadrangular indentations, arranged between the different segments of the flanges of the semi-cylindrical halves, and of a rail on its surface, arranged adjacent to the flanges.

BRIEF DESCRIPTION OF THE DRAWINGS

In the attached drawing, a preferred embodiment of the demountable reel is illustrated by way of non-limiting example. In said drawings.

DETAILED DESCRIPTION OF THE DRAWINGS

Figure 4:
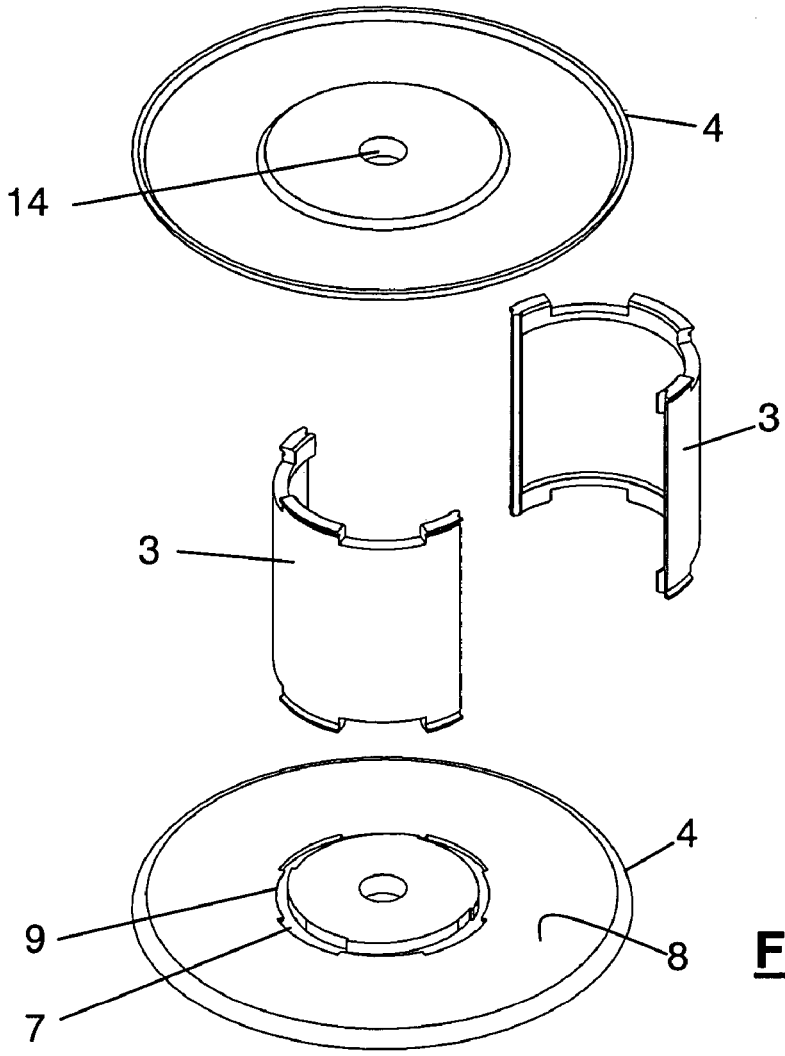
FIG. 4 is an exploded view, wherein the parts are in a correlative assembly position, of the demountable reel of the invention.
Figure 5:
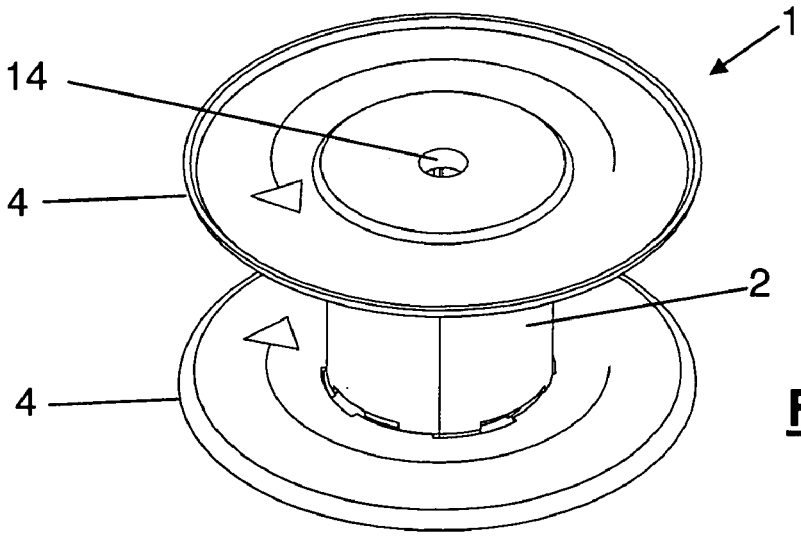
FIG. 5 is a perspective view of the demountable reel wherein the discs and the cylindrical central body are coupled together.

The demountable reel 1 represented in FIGS. 4 and 5 is formed by a cylindrical central body 2, divided in two semi-cylindrical halves 3, and two essentially flat identical discs 4, with a greater diameter than that of the cylindrical body 2, adapted to be removably coupled to the bases of the cylindrical central body 2.

Figure 1:
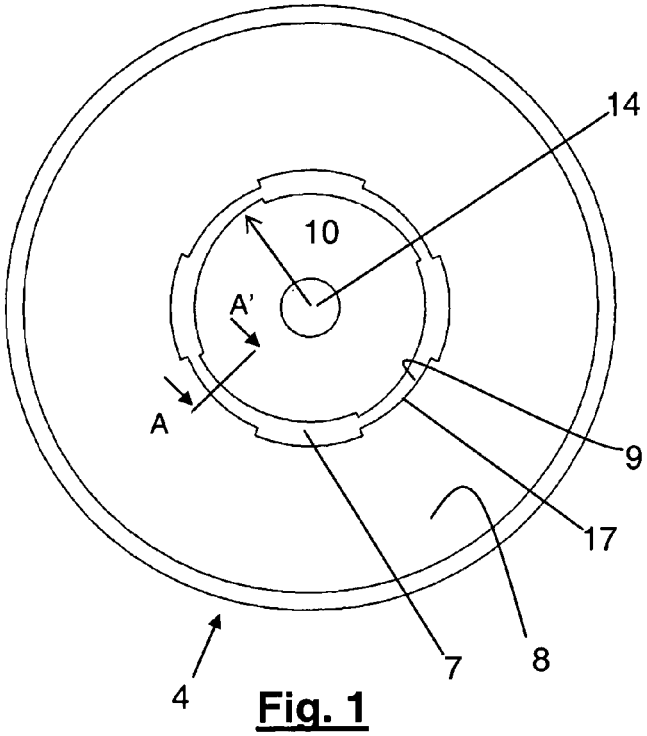
FIG. 1 is a plan view of one of the end discs of the demountable reel.

As indicated in FIG. 1, each disc 4 is equipped on its inner face 8 with a continuous annular groove 7, which has discontinuous projections 17, radially orientated, which define a discontinuous guide rail 9.

On the other hand, the hollow cylindrical central body 2 is equipped, on the rims 5 of its bases, with flanges 6 that project outwards. The length and the arrangement of the flanges 6 at the circumferential ends of the hollow cylindrical central body 2, coincides with the length and arrangement of the segments 11 of the annular groove 7 of each disc 4, free from projections 17, and therefore with open section, so that, when the hollow cylindrical central tube 2 is coupled to the discs 4, the flanges 6 fit together with the open-section segments 11 of the annular groove 7 of the discs 4, which means that after performing a relative rotation of the hollow cylindrical central body 2 in relation to the discs 4, the flanges 6 are inserted in the guide rails 9. In this position, the projection 17 prevents the separation of the hollow cylindrical central body 2 when a separating force is exerted axially.

Figure 2:
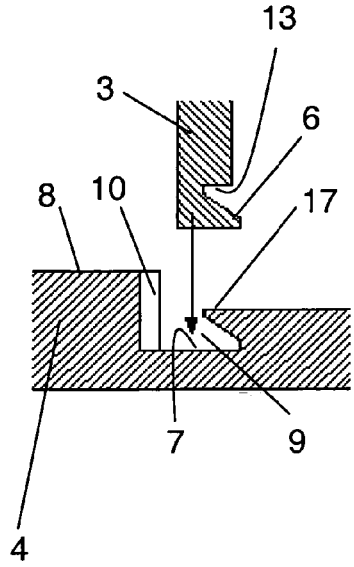
FIG. 2 is a section view of the disc of FIG. 1 and according to AA'.

As can be observed in FIG. 2, the section of the guide rails 9 is markedly tapered and coincident with the section of the flanges 6 of the hollow cylindrical central body 2, also of tapered or triangular section.

Figure 3:
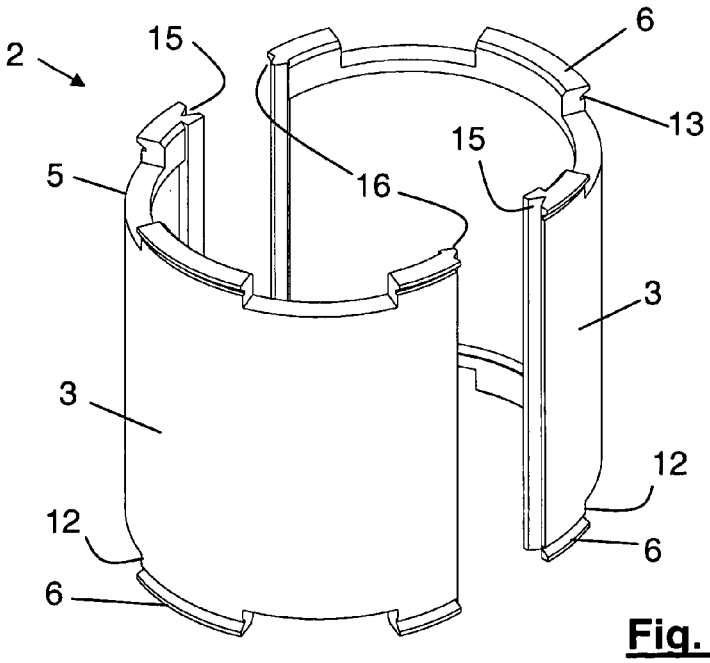
FIG. 3 is a perspective view of the two halves of the cylindrical central body of the demountable reel.

Indeed, FIG. 3 shows in detail the flanges 6 of the hollow cylindrical central body 2, in addition to showing that, in the embodiment represented in the drawings said hollow cylindrical central body 2 is formed by two identical semi-cylindrical halves 3, joined together by a diametral plane.

Each semi-cylindrical half 3 is equipped, on its respective longitudinal rims which couple with the other complementary half, with a groove 15 which extends longitudinally along one of the surfaces and a rib 16, also longitudinal, on the other surface, so that when both semi-cylindrical halves 3 are opposite one another to form the hollow cylindrical body 2, the rib 16 of the first semi-cylindrical half 3 fits in the groove 15 of the second semi-cylindrical half 3, while the groove 15 of the first half receives the rib 16 of the second. Once the two halves 3 are opposite one another, they are firmly joined together when the flanges 6 are inserted in the guide rails 9 of one of the discs of the demountable reel 1.

Preferably, the semi-cylindrical halves 3 share the same flange 6 segment when opposite one another and form the hollow cylindrical central body 2, so that the same guide rail 9 acts as a joint between both semi-cylindrical halves 3, in addition to housing the hollow cylindrical central body 2 that form both parts.

To improve the coupling between the parts, the section of each one of the guide rail 9 segments, and in the same direction, markedly decreases, so that when the hollow cylindrical central body 2 is rotated in the direction of the reduction in the guide rail 9 section, the flanges 6 are fixed by pressure against the walls of the guide rail 9.

In FIG. 1, it can be observed that the interior diameter 10 of the annular groove 7 of the discs 4 progressively increases, reducing the through section of the guide rail 9. The greater the degree of rotation of the hollow cylindrical central body 2 in relation to the discs 4, the greater the pressure exerted on the flanges 6 against the walls of the guide rail 9 will be, for which reason, the fixing between the bodies will be greater.

As the discs 4 are identical, and as they are arranged on opposite rims 5 of the central body, the direction of rotation of each disc 4 in relation to the central body that has to be performed to increase the tightening or fixing thereto is opposite, which further facilitates the fitting of the demountable reel 1, since it is not necessary to maintain the hollow cylindrical central body 2 fixed and rotate each one of the discs 4, instead, the disc and the central body is tightened by simply rotating the discs 4 in opposite directions.

Furthermore, as the end discs 4 are fixed, it prevents the reel from uncoupling if the hollow cylindrical central body 2 rotates in any direction, since said rotation of the central body is translated, in one of the two discs, in a greater tightening between said central body and the disc, even managing to prevent the rotation of the central body in relation to the disc due to the fact that the flange 6 cannot move along the inside of the guide rail 9, as the section of the latter is less than that of the flange 6. Whatever the rotation direction of the central body, as the discs remain fixed in relation to one another, the central body not only cannot become uncoupled, but it will be progressively more fixed to one of the discs.

With the purpose of further ensuring the fastening between the discs 4 and the hollow cylindrical central body 2, and to avoid breaking due to elevation of the projections 17 due to excessive tightening, the semi-cylindrical halves 3 are equipped with a rail 13 on their surface, arranged adjacent to the flanges 6 and for the purpose of receiving, in the coupling position, the projections 17 of the guide rails 9 of the discs, avoiding that the projections 17 bend outwards due to the pressure exerted by the flanges 6 of the semi-cylindrical halves 3.

Furthermore, so that the side walls of the semi-cylindrical halves 3 do not interfere with the projections 17 when the hollow cylindrical central body 2 is rotated, the semi-cylindrical halves 3 are equipped, on one of their rims 5, with indentations 12, preferably quadrangular, arranged between the different segments of the annular flanges 6.

As is shown in FIGS. 1, 4 and 5, the discs 4 are further equipped with central openings 14 through which, once the reel is assembled, the drive shaft, where one wants to mount the reel, can pass.

Figure 6:
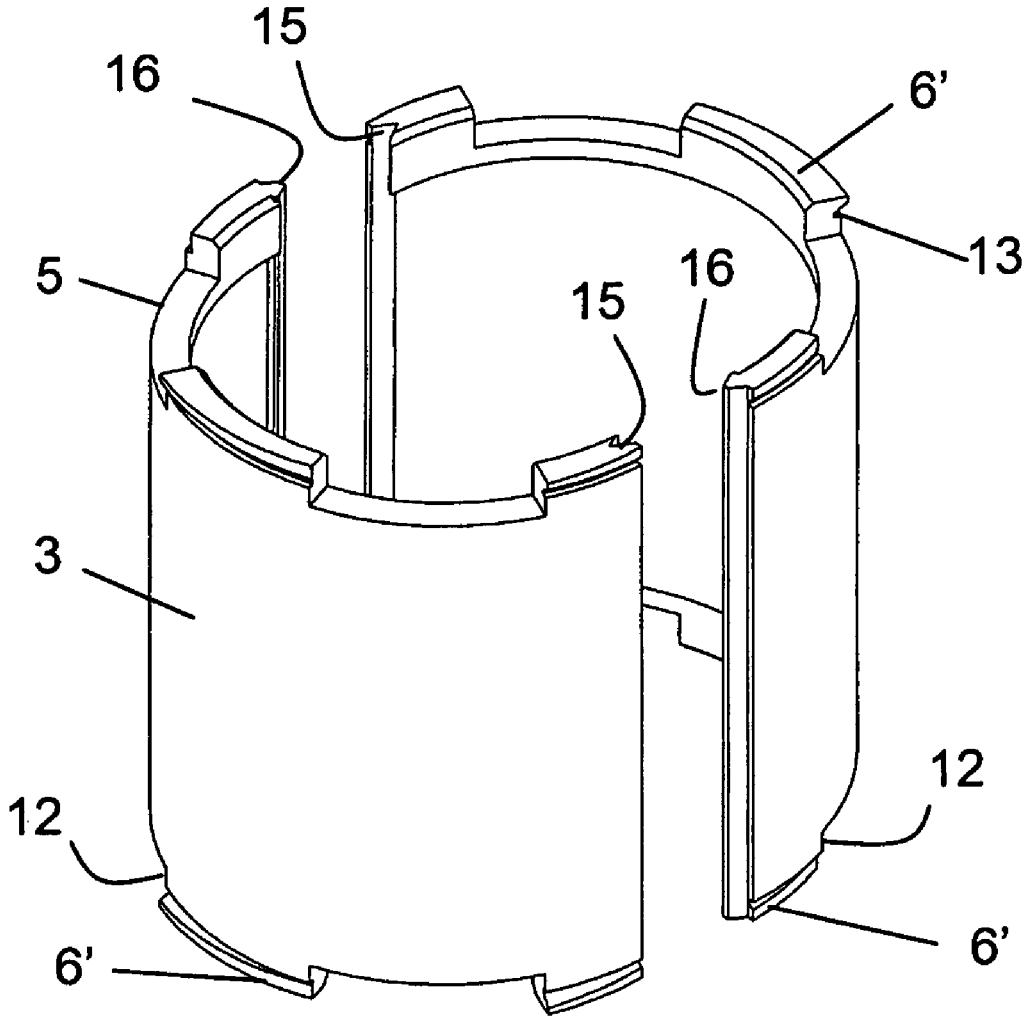
FIG. 6 is a perspective view of the two halves of the cylindrical central body of the demountable wheel including variable flanges.

It should be stated that for the cylindrical central body 2 and the discs 4 to couple and for the flanges 6 to be fixed by pressure against the walls of the guide rail 9 when the hollow cylindrical central body 2 is rotated in a movement similar to winding. As shown in FIG. 6, it is also planned that the flanges 6' markedly increase their section and the section of the guide rails 9 is constant, so that, when the hollow cylindrical central body is rotated in the direction of increase in section of the flanges 6', they are fixed to the guide rail 9 by pressure against the walls thereof, just having to rotate said central body in the opposite direction, as has been described in the embodiment represented in the drawings, to be able to easily disassemble the reel.

Likewise, in another possible embodiment of the demountable reel 1, both the flanges 6 and the segments of guide rail 9 have a variable section, in this case the section of the flanges progressively increases, while the section of the segments of the guide rail 9 used to house said flanges progressively decreases.

The invention claimed is:

1. A demountable reel (1), comprising a hollow cylindrical central body (2), divided in two equal semi-cylindrical halves (3) by a diametral plane, and two essentially flat discs (4), of greater diameter and equipped with central openings (14), arranged on the bases of the hollow cylindrical central body, characterized in that the semi-cylindrical halves are equipped, on rims of their bases (5), with flanges (6) projected transversally from the semi-cylindrical halves, and in that each disc is equipped, on its inner face (8), with an annular groove (7), which defines a discontinuous guide rail (9) adapted to removably receive the flanges of one of the ends of the semi-cylindrical halves of the hollow cylindrical central body, at least one of the guide rail and the flanges of the semi-cylindrical halves having segments with a cross section that varies over a length thereof, causing, when the hollow cylindrical central body is rotated in relation to the discs, that the clearance between the flanges and walls of the guide rail which house the flanges is reduced until it disappears, all the flanges being simultaneously wedged to the guide rail, and rotating said central body in the opposite direction separating the discs.

2. The demountable reel (1) according to claim 1, characterized in that the section of each one of the flanges (6) of the semi-cylindrical halves is homogenous and in that the section of each segment of the guide rails (9) of the disc (4) progressively decreases.

3. The demountable reel (1) according to claim 2, characterized in that the interior diameter (10) of the annular groove (7) is progressively greater in those segments (11) coincident with the segments of the guide rail (9), which produces a progressive reduction in the section of the guide rail.

4. The demountable reel (1) according to claim 1, characterized in that the section of the guide rails (9) is homogenous and in that the section of each one of the flanges (6) of the semi-cylindrical halves progressively increases.

5. The demountable reel (1) according to claim 1, characterized in that each one of the flanges (6) of the semi-cylindrical halves progressively increases and in that the section of each segment of the guide rails (9) of the discs (4) progressively decreases.

6. The demountable reel (1) according to claim 5, characterized in that the interior diameter (10) of the annular groove (7) is progressively greater in those segments (11) coincident with the segments of the guide rail (9), which produces a progressive reduction in the section of the guide rail.

7. The demountable reel (1) according to claim 1, characterized in that an interior diameter (10) of the annular groove (7) is progressively greater in those segments (11) coincident with the segments of the guide rail (9), which produces a progressive reduction in the section of the guide rail.

8. The demountable reel (1) according to claim 1, characterized in that the flanges (6) of the semi-cylindrical halves (3) of the hollow cylindrical central body, have an essentially triangular section and because the guide rail (9) has an essentially tapered section corresponding to that of the flanges.

9. The demountable reel (1) according to claim 1, characterized in that the semi-cylindrical halves (3) are equipped at their circumferential ends (5) with quadrangular indentations (12), arranged between the different segments of the flanges (6) of the semi-cylindrical halves, and of a rail (13) on its surface, arranged adjacent to the flanges.

10. The demountable reel according to claim 1, wherein the flanges project transversally outwards from the semi-cylindrical halves.

* * * * *